US011367580B2

(12) United States Patent
Yang et al.

(10) Patent No.: US 11,367,580 B2
(45) Date of Patent: Jun. 21, 2022

(54) KEYSWITCH STRUCTURE

(71) Applicant: Darfon Electronics Corp., Taoyuan (TW)

(72) Inventors: Sung-Fu Yang, Taoyuan (TW); Po-Chun Hou, Taipei (TW)

(73) Assignee: DARFON ELECTRONICS CORP., Taoyuan (TW)

( * ) Notice: Subject to any disclaimer, the term of this patent is extended or adjusted under 35 U.S.C. 154(b) by 0 days.

(21) Appl. No.: 16/870,263

(22) Filed: May 8, 2020

(65) Prior Publication Data

US 2020/0357583 A1 Nov. 12, 2020

(30) Foreign Application Priority Data

May 10, 2019 (TW) ..... 108116328

(51) Int. Cl.

| | |
|---|---|
| ***H01H 13/14*** | (2006.01) |
| ***H01H 13/20*** | (2006.01) |
| ***H01H 3/12*** | (2006.01) |
| ***H01H 13/7065*** | (2006.01) |

(52) U.S. Cl.

CPC ..... *H01H 13/14* (2013.01); *H01H 3/12* (2013.01); *H01H 13/20* (2013.01); *H01H 13/7065* (2013.01); *H01H 2221/04* (2013.01); *H01H 2221/09* (2013.01)

(58) Field of Classification Search

CPC ..... H01H 13/14; H01H 13/20; H01H 3/12; H01H 13/7065; H01H 2221/09; H01H 2221/04; H01H 3/122; H01H 3/125; H01H 2221/062; H01H 13/52; H01H 36/004; H01H 36/0073; H01H 2036/0093

See application file for complete search history.

(56) References Cited

U.S. PATENT DOCUMENTS

| | | | |
|---|---|---|---|
| 9,064,651 B2 | 6/2015 | Hsu et al. | |
| 9,099,261 B2 | 8/2015 | Hsu et al. | |
| 9,236,205 B2 * | 1/2016 | Hsu | H01H 5/02 |

(Continued)

FOREIGN PATENT DOCUMENTS

| | | |
|---|---|---|
| CN | 103681062 A | 3/2014 |
| CN | 104051175 A | 9/2014 |

(Continued)

*Primary Examiner* — Lheiren Mae A Caroc

(74) *Attorney, Agent, or Firm* — Muncy, Geissler, Olds & Lowe, P.C.

(57) ABSTRACT

A keyswitch structure includes a keycap, a baseplate having a buffer space, a support movably disposed between the baseplate and the keycap, a magnetic member having a front section coupling the support, a middle section and a tail end, a magnetic unit disposed below the magnetic member, a switch film having a flexible portion extending over the buffer space. When the keycap is pressed, the support enables the magnetic member to move away from the magnetic unit, so the tail end is away from the flexible portion. When the keycap is released, a magnetic attraction force between the magnetic member and the magnetic unit enables the magnetic member to move toward the magnetic unit, so the tail end firstly contacts and pushes the flexible portion to deform toward the buffer space, and then the middle section contacts the magnetic unit to drive the support to support the keycap upward.

15 Claims, 12 Drawing Sheets

(56) References Cited

U.S. PATENT DOCUMENTS

| | | | | |
|---|---|---|---|---|
| 9,343,247 | B2 | 5/2016 | Hsu | |
| 9,396,893 | B2 | 7/2016 | Yen | |
| 9,412,535 | B2 | 8/2016 | Hsu | |
| 9,508,505 | B2 | 11/2016 | Hsu | |
| 9,953,776 | B2 | 4/2018 | Liao et al. | |
| 9,959,991 | B2 | 5/2018 | Chen | |
| 9,966,202 | B2 | 5/2018 | Liao et al. | |
| 9,984,840 | B2 | 5/2018 | Hsu | |
| 10,008,345 | B2 | 6/2018 | Hsu | |
| 10,236,138 | B2 * | 3/2019 | Chen | H01H 13/7065 |
| 10,381,175 | B2 * | 8/2019 | Yang | H01H 3/60 |
| 10,804,049 | B1 * | 10/2020 | Hsieh | H01H 13/52 |
| 10,930,450 | B2 * | 2/2021 | Chao | H01H 13/52 |
| 2016/0329174 | A1 | 11/2016 | Chen et al. | |
| 2016/0351349 | A1 | 12/2016 | Chen et al. | |
| 2017/0278650 | A1 | 9/2017 | Chen et al. | |
| 2019/0155401 | A1 | 5/2019 | Chen et al. | |

FOREIGN PATENT DOCUMENTS

| | | | |
|---|---|---|---|
| CN | 103745860 | B | 11/2015 |
| CN | 208819783 | U | 5/2019 |
| TW | M410967 | U | 9/2011 |
| TW | M416801 | U | 11/2011 |
| TW | I475585 | B | 3/2015 |
| TW | I523058 | B | 2/2016 |
| TW | I555050 | B | 10/2016 |
| TW | I625749 | B | 6/2018 |
| TW | I636474 | B | 9/2018 |
| TW | I663621 | B | 6/2019 |
| TW | I669738 | B | 8/2019 |
| TW | I671773 | B | 9/2019 |
| TW | I674601 | B | 10/2019 |
| TW | I674607 | B | 10/2019 |
| TW | I681430 | B | 1/2020 |

* cited by examiner

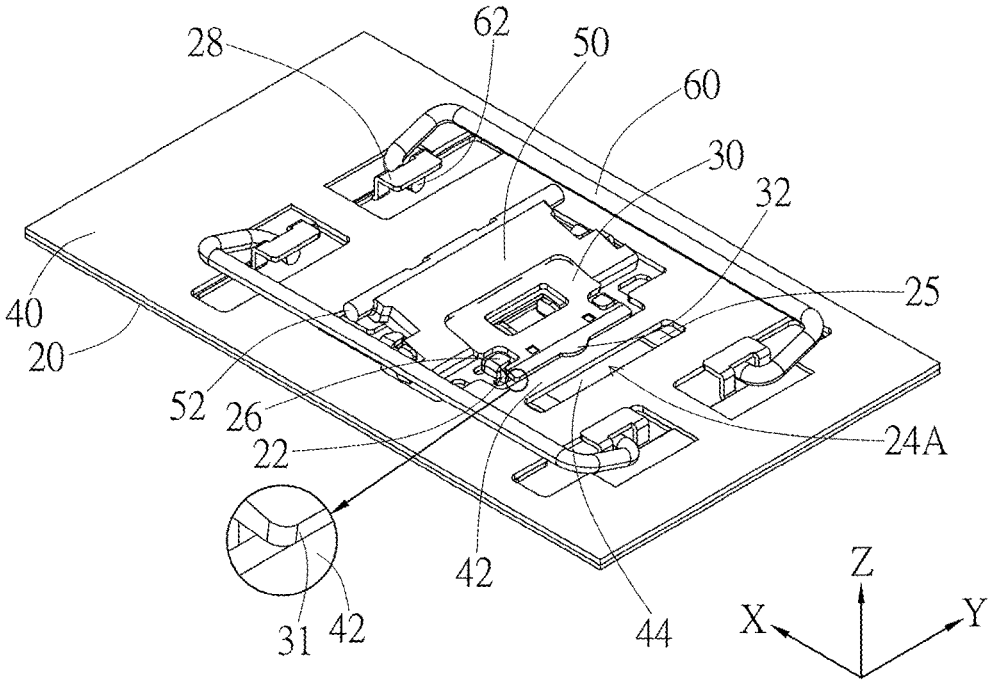
FIG. 1B
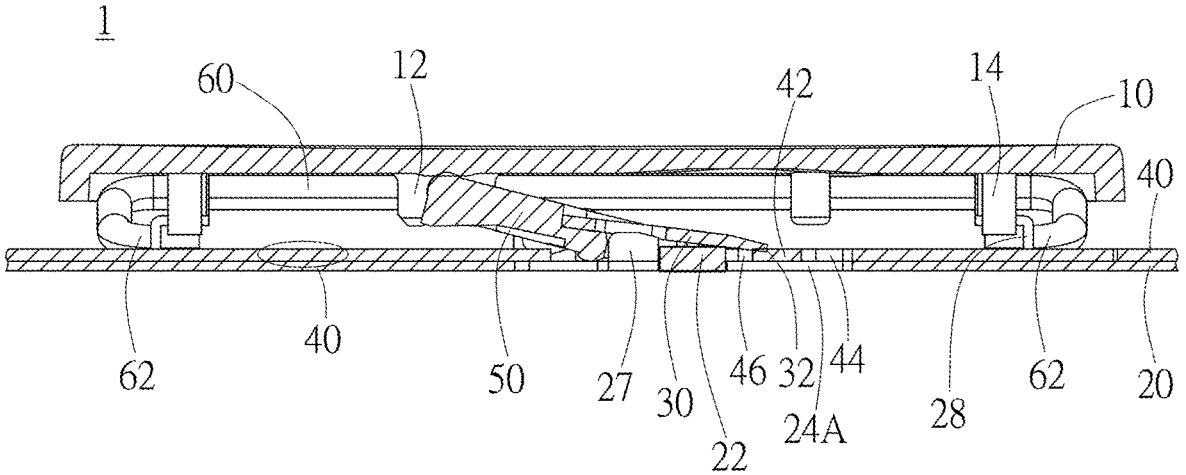
FIG. 1C
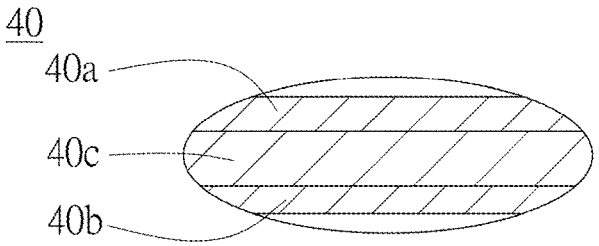
FIG. 1C1

KEYSWITCH STRUCTURE

BACKGROUND OF THE INVENTION

1. Field of the Invention

The invention generally relates to a keyswitch structure. Particularly, the invention relates to a keyswitch structure having a noise-reduction design.

2. Description of the Prior Art

Conventional magnetic keys utilize the magnetic attraction between magnetic elements, such as magnets, iron plate, as the restoring force to enable the keycap to return to the non-pressed position after being pressed. However, during the return of the keycap to the non-pressed position by the magnetic attraction, the magnetic elements move toward each other and then collide with each other to generate noisy sounds. Since the impact between the magnetic elements is an impact between metals, the noise issue becomes more significant.

SUMMARY OF THE INVENTION

It is an object of the invention to provide a keyswitch structure having a noise-reduction design.

In an embodiment, the invention provides a keyswitch structure including a keycap, a baseplate disposed below the keycap, the baseplate having a buffer space, a support movably disposed between the baseplate and the keycap, a magnetic member having a front section, a middle section, and a tail end, the front section coupling with the support, a magnetic unit disposed below the magnetic member, and a switch film disposed on the baseplate, the switch film having a flexible portion extending over the buffer space, wherein when the keycap is pressed, the support enables the magnetic member to move away from the magnetic unit, so the tail end is away from the flexible portion, and wherein when the keycap is released, a magnetic attraction force between the magnetic unit and the magnetic member enables the magnetic member to move toward the magnetic unit, so the tail end firstly contacts the flexible portion and pushes the flexible portion to deform toward the buffer space, and then the middle section contacts the magnetic unit to drive the support to support the keycap upward.

In an embodiment, the tail end has an edge and an extension portion protruding from the edge. When the keycap is released, the magnetic attraction force enables the magnetic member to move toward the magnetic unit, so only the extension portion firstly contacts the flexible portion to push the flexible portion to deform toward the buffer space, and the edge maintains separately from the flexible portion.

In an embodiment, when the keycap is released and the extension portion contacts the flexible portion, a vertical projection of the edge of the tail end on the baseplate and a vertical projection of the flexible portion on the baseplate do not overlap with each other.

In an embodiment, the extension portion is bent toward the flexible portion with respect to the edge.

In an embodiment, the tail end has a bump. The bump protrudes from a bottom surface of the tail end toward the flexible portion.

In an embodiment, the baseplate further has a receiving space and positioning portions. The receiving space communicates with the buffer space, and the positioning portions are disposed at two opposite sides neighboring the receiving space.

In an embodiment, the switch film has a structure of multiple layers, and the flexible portion is formed by at least one of the multiple layers of the switch film.

In an embodiment, the switch film has a film body, and the flexible portion is a bridging portion with two ends connected to the film body to define two openings with the film body at two sides of the flexible portion.

In an embodiment, the switch film has a film body, and the flexible portion is a tongue portion extending from the film body to have a free end corresponding to the tail end. The free end is adjacent to and below the tail end.

In an embodiment, the switch film has a film body, and the flexible portion is a bridge structure extending from the film body and having a suspension section adjacent to and below the tail end.

In an embodiment, the baseplate has a support portion, and the support portion partially supports the flexible portion.

In an embodiment, the support portion protrudes toward the keycap, so that the flexible portion is closer to the keycap than a film body of the switch film.

In an embodiment, the keycap has a protrusion. The protrusion extends from a bottom surface of the keycap toward the baseplate. The baseplate has an accommodation space corresponding to the protrusion. The switch film covers the accommodation space. When the keycap is pressed, the protrusion presses the switch film into the accommodation space.

In an embodiment, the magnetic member further has a bump extending from a bottom surface of the magnetic member. When the keycap is released, the magnetic member contacts the magnetic unit by the bump to support the keycap at a non-pressed position.

In another embodiment, the invention provides a keyswitch structure including a keycap, a baseplate disposed below the keycap, a support movably disposed between the baseplate and the keycap, a magnetic member coupling with the support, the magnetic member having a bump extending from a bottom surface of the magnetic member toward the baseplate, and a magnetic unit disposed below the magnetic member, wherein when the keycap is pressed, the support drives the magnetic member to move away from the magnetic unit, and wherein when the keycap is released, a magnetic attraction force between the magnetic unit and the magnetic member enables the magnetic member to move toward the magnetic unit, so the bump contacts the magnetic unit to drive the support to support the keycap upward.

Compared with the prior art, the keyswitch structure of the invention provides a buffering effect before the magnetic elements collide with each other, so as to reduce the noises generated when the magnetic elements are in contact with each other, which is beneficial to improve the user's operation experience.

BRIEF DESCRIPTION OF THE DRAWINGS

FIG. 1B is a schematic view of the keyswitch structure of FIG. 1A without the keycap at the non-pressed position.

FIG. 1C is a cross-sectional view of the keyswitch structure of FIG. 1A at the non-pressed position, and FIG. 1C1 is an exemplary enlarged view of the switch film of FIG. 1C.

DETAILED DESCRIPTION OF THE PREFERRED EMBODIMENT

The invention provides a keyswitch structure, which can be applied to any pressing type input devices such as keyboard or integrated into any suitable electronic devices such as key buttons of portable electronic devices or keyboard of laptop computers, to reduce noise and promote operating experience. Hereinafter, the structure and operation of elements of the keyswitch structure of the invention will be described in detail with reference to the drawings.

Figure 1A:
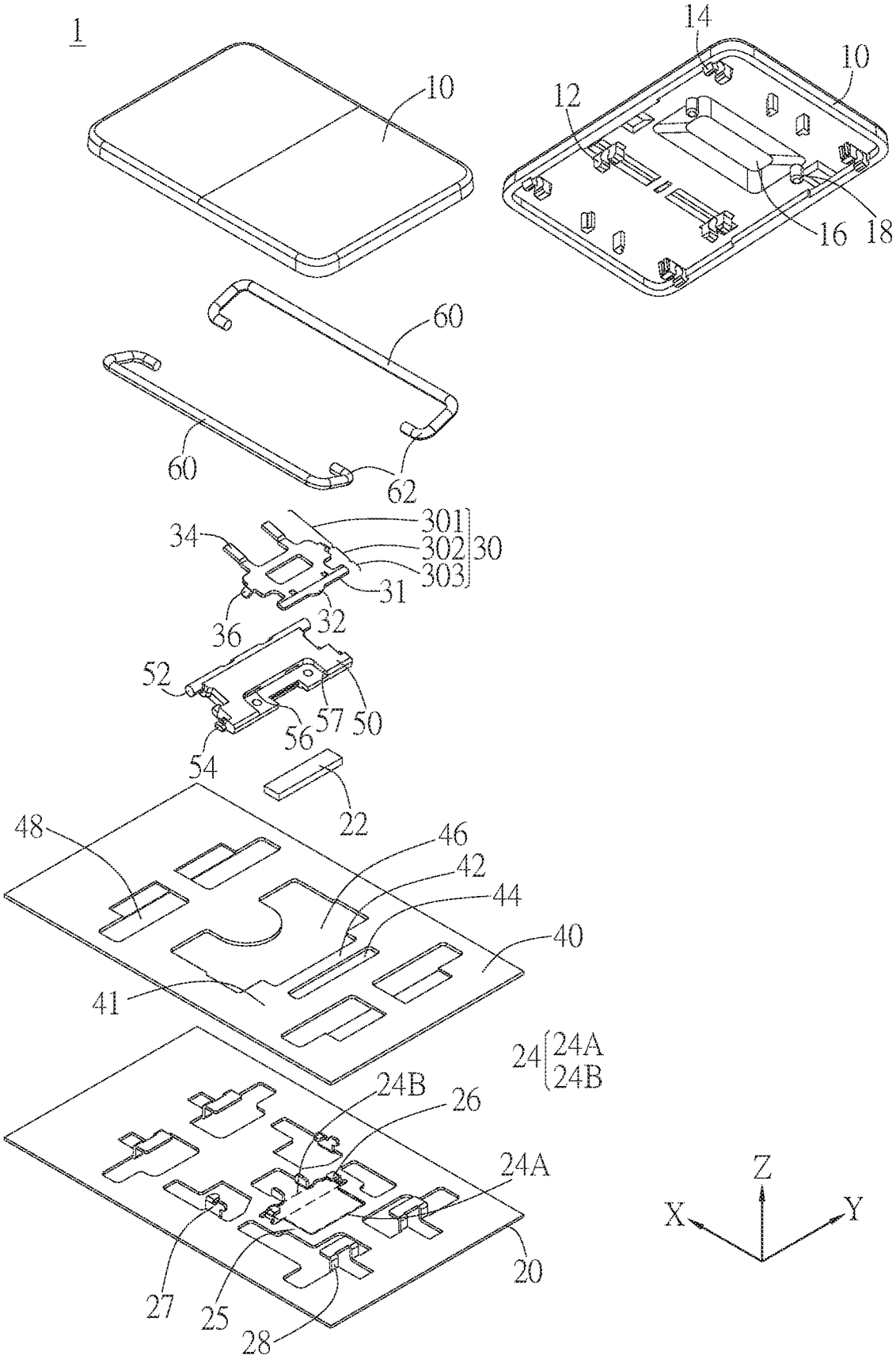
FIG. 1A is an exploded view of the keyswitch structure in an embodiment of the invention.
Figure 2A:
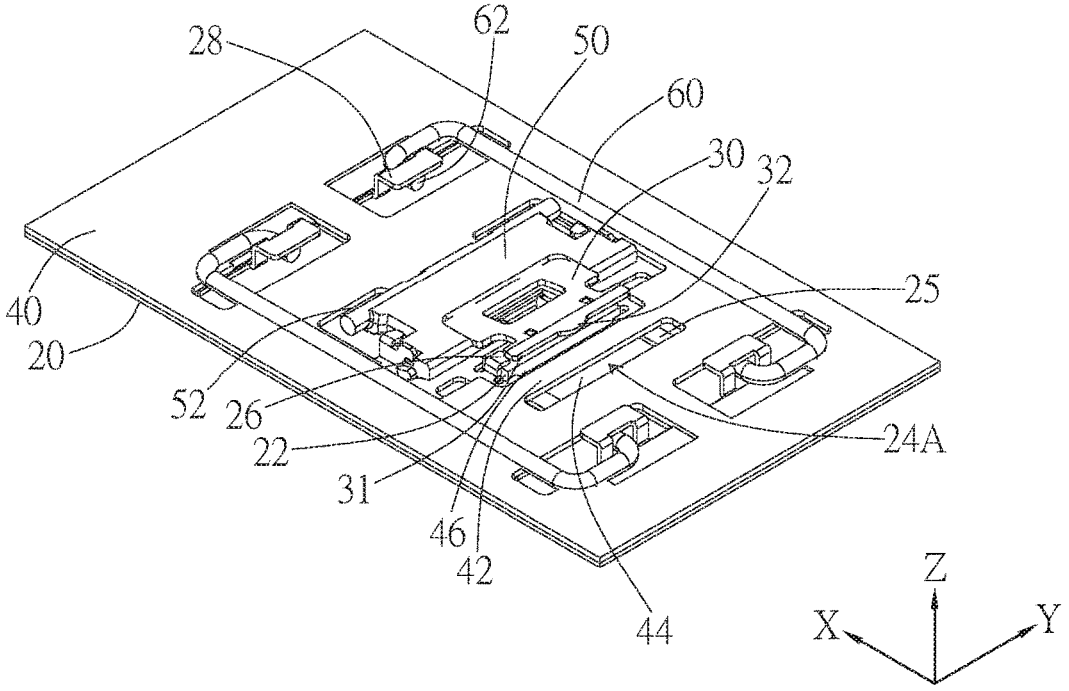
FIG. 2A is a schematic view of the keyswitch structure of FIG. 1A without the keycap at the pressed position.
Figure 2B:
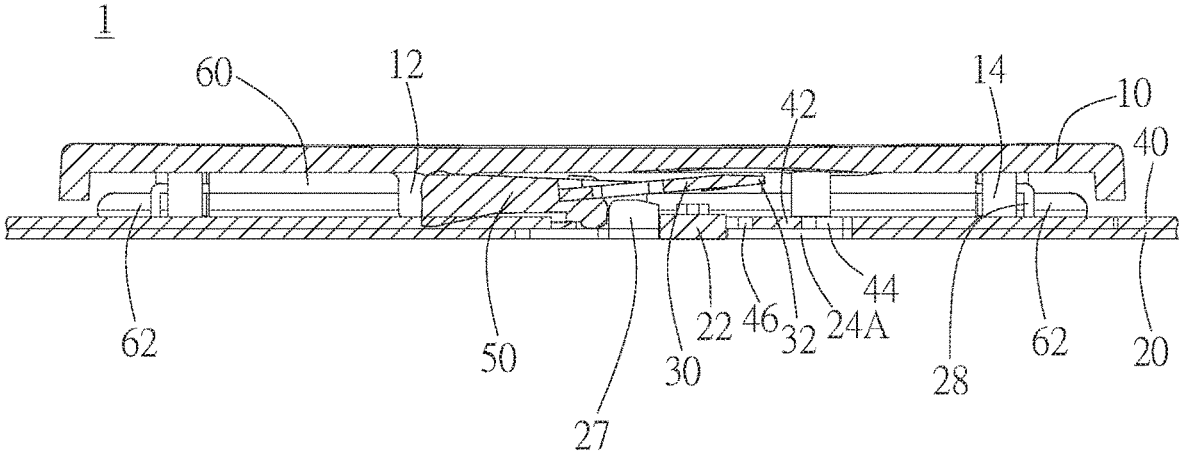
FIG. 2B is a cross-sectional view of the keyswitch structure of FIG. 1A at the pressed position.

FIG. 1A is an exploded view of the keyswitch structure in an embodiment of the invention. FIG. 1B is a schematic view of the keyswitch structure of FIG. 1A without the keycap at the non-pressed position. FIG. 1C is a cross-sectional view of the keyswitch structure of FIG. 1A at the non-pressed position. As shown in FIGS. 1A to 1C, in an embodiment, the keyswitch structure 1 includes a keycap 10, a baseplate 20, a support 50, a magnetic member 30, a magnetic unit 22, and a switch film 40. The baseplate 20 is disposed below the keycap 10. The baseplate 20 has a buffer space 24A. The support 50 is movably disposed between the baseplate 20 and the keycap 10. The magnetic member 30 has a front section 301, a middle section 302, and a tail end 303. The front section 301 couples with the support 50. The magnetic unit 22 is disposed below and corresponding to the magnetic member 30. A magnetic attraction force exists between the magnetic member 30 and the magnetic unit 22. The switch film 40 is disposed on the baseplate 20, and the switch film 40 has a flexible portion 42 extending over the buffer space 24A. As shown in FIGS. 2A and 2B, when the keycap 10 is pressed, the support 50 enables the magnetic member 30 to move away from the magnetic unit 22, so the tail end 303 is away from the flexible portion 42. As shown in FIGS. 1B and 1C, when the keycap 10 is released, the magnetic attraction force between the magnetic unit 22 and the magnetic member 30 enables the magnetic member 30 to move toward the magnetic unit 22, so the tail end 303 firstly contacts the flexible portion 42 and pushes the flexible portion 42 to deform toward the buffer space 24A, and then the middle section 302 contacts the magnetic unit 22 to drive the support 50 to support the keycap 10 upward. In addition, according to practical applications, the keyswitch structure 1 may optionally include other components. For example, the keyswitch structure 1 may further include a linking bar 60 (described later).

Specifically, the keycap 10 can be, for example, an injection molded keycap. In an embodiment, the keycap 10 is preferably a rectangular keycap, which extends along the X-axis direction and the Y-axis direction, but not limited thereto. According to practical applications, the keycap 10 may have different shapes such as circular shape or any suitable geometric shapes. Corresponding to the support 50 and the linking bar 60, the keycap 10 has coupling portions 12 and 14 at its bottom surface. In other words, the coupling portions 12 and 14 protrude from the bottom surface of the keycap 10 along the Z-axis direction and are configured to couple with the support 50 and the linking bar 60. For example, the coupling portions 12 and 14 can be a coupling structure having a slot. Moreover, the bottom surface of the keycap 10 may optionally have a recessed portion 16, which corresponds to the tail end 303 of the magnetic member 30, to increase the moving space for the magnetic member 30 in the Z-axis direction. According to practical applications, the keycap 10 may be a keycap having a transparent portion for use in a luminous keyboard.

The baseplate 20 can function as a support plate for enhancing the structural strength of the keyswitch structure 1. In an embodiment, the baseplate 20 is preferably a metal plate formed by stamping, and the buffer space 24A is preferably a through hole or an opening formed on the baseplate 20, but not limited thereto. In another embodiment (not shown), the buffer space 24A can be formed as a recessed groove in the baseplate 20. For example, the buffer space 24A can be a space recessed downward from the upper surface of the baseplate 20. The magnetic unit 22 can be a magnet or any magnetic elements, which can produce the magnetic attraction force with the magnetic member 30. The magnetic unit 22 is preferably positioned on the baseplate 20 by positioning mechanism. In an embodiment, the baseplate 20 preferably has positioning portions 26 and a receiving space 24B. The positioning portions 26 are disposed at two opposite sides neighboring the receiving space 24B, and the magnetic unit 22 can be disposed in the receiving space 24B. In an embodiment, the receiving space 24B preferably communicates with the buffer space 24A to be two adjacent spaces of a unitary space or opening 24, but not limited thereto. In other embodiments, the receiving space 24B and the buffer space 24A can be independent spaces or openings. The positioning portion 26 preferably protrudes from the surface of the baseplate 20 toward the keycap 10 and is bent to form an L-shaped positioning post to position the magnetic unit 22. For example, two positioning portions 26 are preferably disposed on two opposite sides of the receiving space 24B along the Y-axis direction, and the magnetic unit 22 is disposed below the positioning portions 26, so the positioning portions 26 and the magnetic unit 22 at least partially overlap with each other in the Z-axis direction and the Y-axis direction. As such, the location of the magnetic unit 22 on the XY plane where the baseplate 20 lies and the height in the Z-axis direction can be defined. Moreover, the baseplate 20 preferably has connection portions 27 and coupling portions 28. The connection portions 27 are configured to connect the support 50. The connection portions 27 are preferably hook-like connecting elements protruding from the baseplate 20 toward the keycap 10 and then bent. The coupling portions 28 are preferably disposed on two opposite sides of the baseplate 20, e.g. two sides along the X-axis direction, and configured to couple the linking bar 60. For example, the coupling portion 28 can be a coupling structure having slots, which protrude from the base plate 20 toward the keycap 10.

The support 50 is movably disposed between the baseplate 20 and the keycap 10 and configured to support the keycap 10 to move upward/downward relative to the baseplate 20. Specifically, the support 50 can be a frame support connected to the keycap 10 and the baseplate 20, and the support 50 has coupling portions 52 and 54 at two opposite ends along the X direction. The coupling portion 52 is preferably in form of a pivotal shaft, which is rotatably coupled to the coupling portion 12 of the keycap 10, and the coupling portion 54 is in form of a protruding rod, which is movably coupled to the connection portion 27 of the baseplate 20, so that the support 50 can support the keycap 10 to move upward/downward relative to the baseplate 20. The support 50 further has coupling slots 56 and 57, which are configured to couple with the front section 301 of the magnetic member 30, to drive the movement of the magnetic member 30.

The magnetic member 30 is disposed corresponding to the magnetic unit 22 between the baseplate 20 and the keycap 10, and a magnetic attraction force exists between the magnetic member 30 and the magnetic unit 22. For example, the magnetic member 30 can be an iron plate or a combination of any suitable material with magnetic material. In an embodiment, the magnetic member 30 is positioned corresponding to the magnetic unit 22 on the support 50, so that when the magnetic member 30 contacts the magnetic unit 22, the tail end 303 and the flexible portion 42 will have a given amount of interference in the Z-axis direction, such as 0.5 mm, but not limited thereto. Specifically, along the X-axis direction, the magnetic member 30 has the front section 301, the middle section 302, and the tail end 303. The front section 301 is configured to couple with the support 50, the middle section corresponds to the magnetic unit 22, and the tail end 303 corresponds to the flexible portion 42. In other words, the front section 301 and the tail end 303 are respectively disposed at two opposite sides of the magnetic member 30, and the magnetic unit 22 is located substantially right below the middle section 302. For example, the magnetic member 30 has engaging portions 34 and 36 at the front section 301, and the engaging portions 34 and 36 correspond to the coupling slots 56 and 57 of the support 50, respectively. In an embodiment, the engaging portion 34 are rod type or bar type engaging portions protruding along the X-axis direction, and the engaging portions 36 are hook-like engaging portions disposed at two opposite sides along the Y-axis direction. The engaging portion 34 extends into the coupling slot 56, and the engaging portion 36 correspondingly couples with the coupling slot 57, so the support 50 and the magnetic member 30 form a linking mechanism.

Moreover, in an embodiment, the tail end 303 preferably has an edge 31 and an extension portion 32, and the extension portion 32 protrudes from the edge 31. For example, the edge 31 is an edge extending along the X-axis direction, and the extension portion 32 preferably at least partially protrudes outward from the edge 31 along the Y-axis direction, so vertical of projections of the extension portion 32 and the flexible portion 42 on the baseplate 20 at least partially overlap with each other, but not limited thereto.

The flexible portion 42 is a portion of the switch film 40, which has a relatively greater amount of deformation compared to other portions of the switch film 40. The flexible portion 42 of the switch film 40 can be formed, for example, by changing the thickness, the material, or the shape thereof. In an embodiment, the switch film 40 includes a film body 41 and the flexible portion 42. The flexible portion 42 has a greater amount of deformation than the film body 41. For example, the flexible portion 42 is formed integrally with the film body 41 to have a relatively greater amount of deformation by partially connecting to the film body 41. In this embodiment, the flexible portion 42 can be a bridging portion with two ends connected to the film body 41 to define two openings 44 and 46 with the film body 41 at two sides of the flexible portion 42. For example, by cutting the switch film 40 to form the openings 44 and 46, the flexible portion 42 with two opposite ends connected to the film body 41 can be formed. In this embodiment, the flexible portion 42 is a bridging portion extending along the Y-axis direction, and the two opposite ends of the flexible portion 42 along the Y-axis direction are connected to the film body 41, so the film body 41 has a right side opening 44 and a left side opening 46 separated by the flexible portion 42. As such, the middle part of the flexible portion 42 has a greater amount of deformation with respect to the two ends which are connected to the film body 41. Moreover, according to practical applications, the flexible portion 42 can extend transversely above the buffer space 24A of the baseplate 20, so that the portion of the baseplate 20 adjacent to the buffer space 24A can be a supporting portion 25 which is configured to support the flexible portion 42, and the amount of deformation of the flexible portion 42 can be adjusted. For example, by enhancing the local structural strength of the flexible portion 42, the amount of deformation can be reduced. Moreover, the opening 46 of the switch film 40 allows the positioning portions 26 and the connection portions 27 to penetrate therethrough, so that the magnetic unit 22 can protrude over the switch film 40, and the connection portions 27 can couple with the support 50.

The linking bar 60 is connected between the keycap 10 and the baseplate 20. That is, one side of the linking bar 60 is connected to the coupling portions 14 of the keycap 10, and the other side of the linking bar 60 is connected to the coupling portions 28 of the baseplate 20, so as to enhance the linking mechanism of the keycap 10. For example, when the keycap is pressed at right side, the left side of the keycap can be lowered at the same time, to prevent the keycap 10 from having a tilting configuration that the right side is lower than the left side. In this embodiment, the linking bar 60 can be a U-shaped bar, and two extension portions 62 extend from two sides of the U-shaped bar toward the opening of the U-shaped bar. The extension portions 62 can act as hook-like portions, which slidably engages with the coupling portions 28 of the baseplate 20. It is noted that the switch film 40 has a corresponding opening 48, which allows the coupling portions 28 to extend from the opening 48, so that the extension portions 62 can be slidably inserted into the slots of the coupling portions 28. Moreover, the linking bar 60 is optionally disposed. According to practical applications, the keyswitch structure may include one or more linking bars 60 or even no linking bar.

Referring to FIGS. 2A and 2B, the operation of the keyswitch structure 1 will be illustrated. As shown in FIGS. 2A and 2B, when the keycap 10 is pressed, the support 50 drives the magnetic member 30 to move away from the magnetic unit 22, so that the tail end 303 is away from the flexible portion 42. Specifically, when the force exerted on the keycap 10 is larger than the magnetic attraction force between the magnetic unit 22 and the magnetic member 30, the keycap 10 moves downward and drives the support 50 and the linking bar 60 to rotate downward, so as to trigger the switch film 40, for example by conducting the switch circuit in the film body 41, to generate the triggering signal. In other words, when the keycap 10 moves downward to trigger the switch film 40, with the location where the coupling portion 54 and the connection portion 27 are coupled as the rotation point, the side of the support 50 having the coupling slots 56 and 57 rotates downward to drive the side of the magnetic member 30 having the engaging portions 34 and 36 (i.e., the front section 301) to rotate downward, so that the middle section 302 and the tail end 303 correspondingly rotate upward away from the magnetic unit 22, and the tail end 303 is partially received in the recessed portion 16 of the keycap 10. For example, the tail end 303 correspondingly rotates upward away from the magnetic unit 22, so that the extension portion 32 is also away from the flexible portion 42 and partially received in the recessed portion 16 of the keycap 10.

As shown in FIGS. 1B and 1C, when the keycap 10 is released, the magnetic attraction force enables the magnetic member 30 to move toward the magnetic unit 22, so the tail end 303 firstly contacts the flexible portion 42 to push the flexible portion 42 to deform toward the buffer space 24A. Then, the middle section 302 contacts the magnetic unit 22 to drive the support 50 to move upward to support the keycap 10 at the non-pressed position. Specifically, when the pressing force is released from the keycap 10, the magnetic attraction force between the magnetic member 30 and the magnetic unit 22 enables the magnetic member 30 to rotate toward the magnetic unit 22, i.e., the middle section 302 and the tail end 303 rotate downward, and the side of the magnetic member 30 having the engaging portions 34 and 36 (i.e., the front section 301) rotates upward to drive the support 50 to move upward, so that the keycap 10 is driven to move away from the baseplate 20, and the support 50 supports the keycap 10 upward at the non-pressed position by means of the magnetic attraction force between the magnetic member 30 and the magnetic unit 22. It is noted that the tail end 303 (e.g. the extension portion 32) has a predetermined interference amount with the flexible portion 42 in the Z-axis direction as the magnetic member 30 contacts the magnetic unit 22. As such, when the magnetic member 30 moves toward the magnetic unit 22, i.e., the middle section 302 and the tail end 303 move downward, the tail end 303 (e.g. the extension portion 32) will firstly contact the flexible portion 42 before the magnetic member 30 (e.g. the middle section 302) contacts the magnetic unit 22. By means of the buffering effect that the flexible portion 42 deforms toward the buffer space 24A, the magnetic member 30 will gradually approach the magnetic unit 22 and the middle section 302 then contacts the magnetic unit 22. As such, the magnetic member 30 is prevented from hardly hitting the magnetic unit 22 to effectively reduce the noise induced by contact.

Moreover, in an embodiment, when the keycap 10 is released, the magnetic attraction force enables the magnetic member 30 to move toward the magnetic unit 22, so preferably only the extension portion 32 firstly contacts the flexible portion 42 to push the flexible portion 42 to deform toward the buffer space 24A, and the edge 31 maintains separately from the flexible portion 42. For example, as shown in the partially enlarged view of FIG. 1B, when the keycap 10 is released and the extension portion 32 contacts the flexible portion 42, a vertical projection of the edge 31 of the tail end 303 on the baseplate 20 and a vertical projection of the flexible portion 42 on the baseplate 20 do not overlap with each other. In other words, when the magnetic member 30 contacts the magnetic unit 22, i.e., the keyswitch structure 1 is at the non-pressed position, the magnetic member 30 preferably has only the extension portion 32 contacting the flexible portion 42 in the Z-axis direction, and the rest portions of the magnetic member 30 do not press the flexible portion 42 in the Z-axis direction. For example, a gap preferably exists between the edge 31 of the magnetic member 30 and the flexible portion 42 in the X-axis direction to enhance the control of the interference amount between the extension portion 32 and the flexible portion 42 in the Z-axis direction, but not limited thereto. In another embodiment, by modifying the design of the tail end 303, the edge 31 of the magnetic member 30 can partially overlap the flexible portion 42 in the Z-axis direction, and the edge 31 can still have a gap from the flexible portion 42, i.e., only the extension portion 32 contacts the flexible portion 42. As such, the control of the interference amount between the extension portion 32 and the flexible portion 42 in the Z-axis direction can also be enhanced.

Figure 3A:
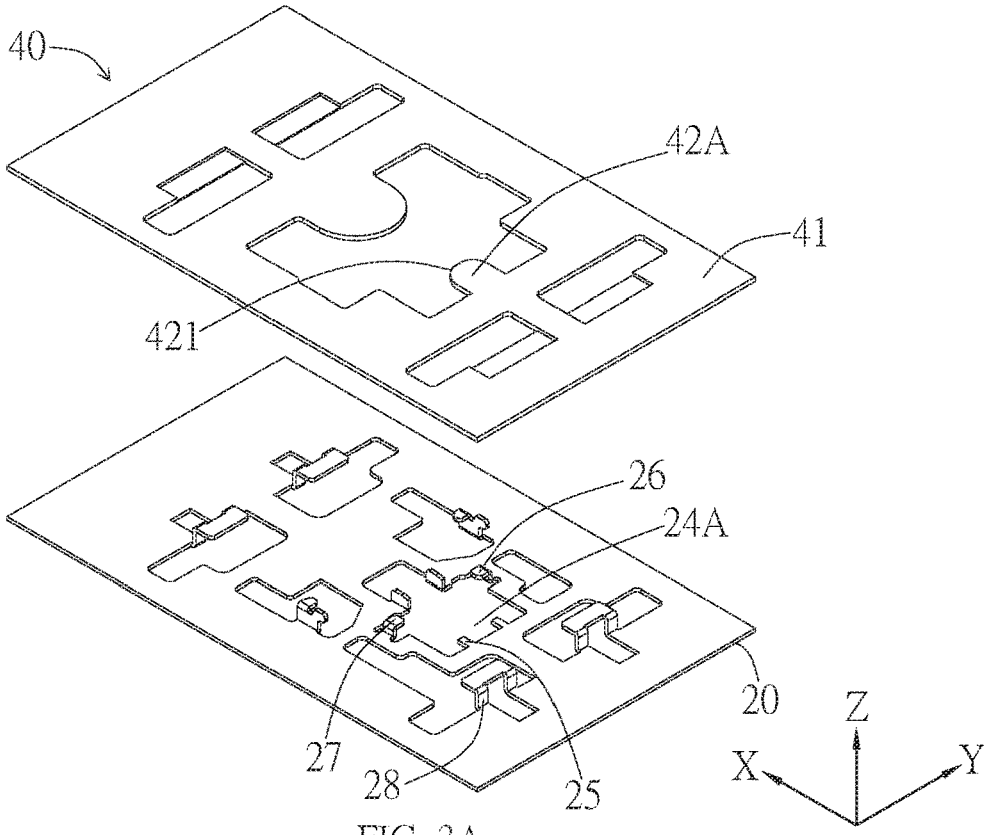
FIGS. 3A to 3C are schematic views of the switch film and the baseplate in variant embodiments of the invention.
Figure 3B:
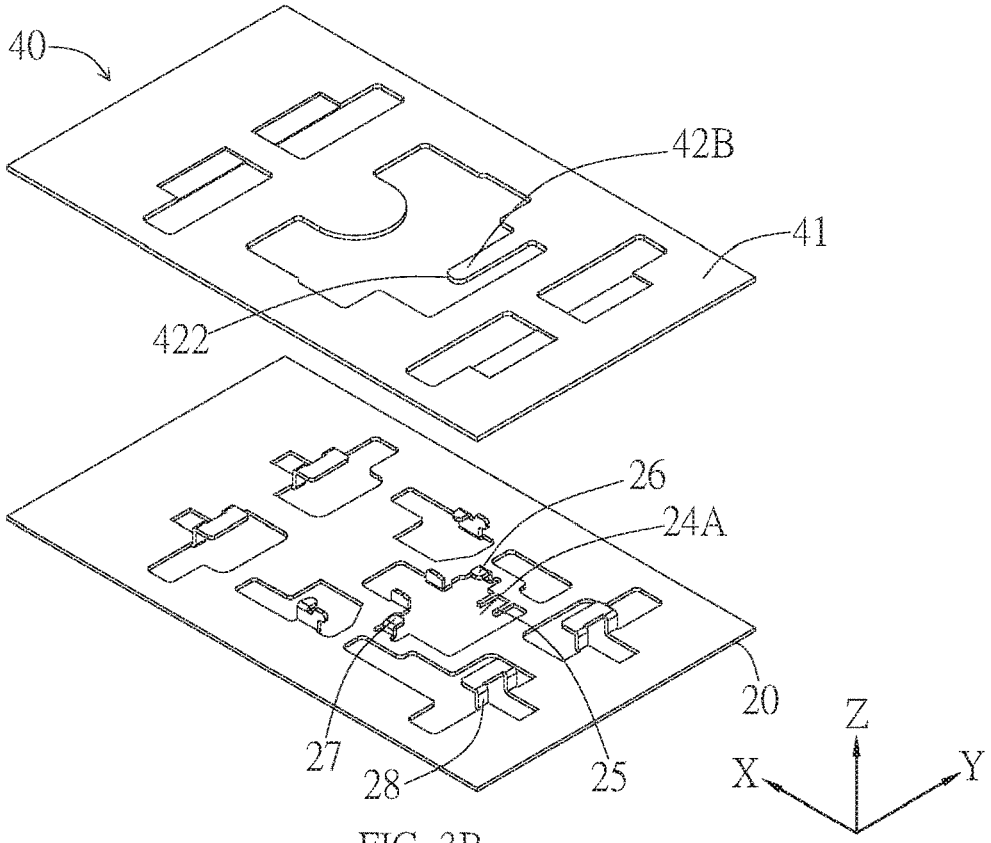
Figure 3C:
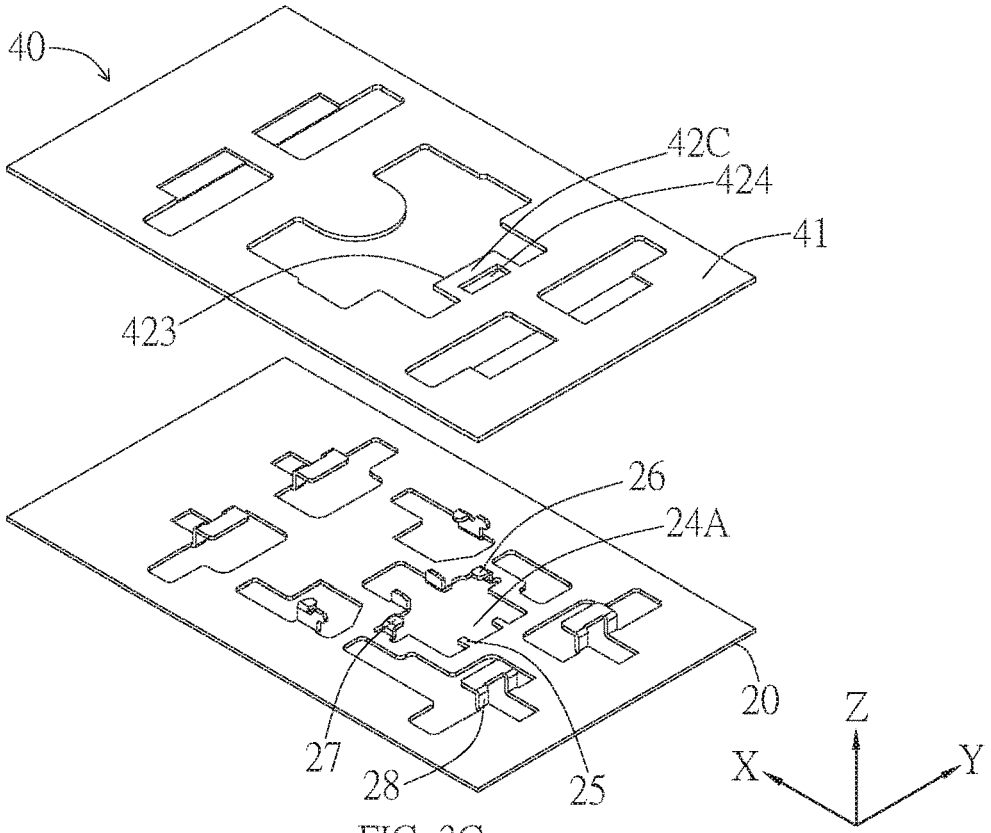

The flexible portion can have different configurations and is not limited to the bridging portion illustrated above. As shown in FIGS. 3A to 3C, in different embodiments, the flexible portions 42A and 42B can a tongue portion, and the flexible portion 42C can be a bridge structure. The tongue portion (e.g. 42A or 42B) extends from the film body 41 to have a free end 421 or 422 corresponding to the tail end 303, and the bridge structure has a suspension section 423 corresponding to the tail end 303. In other words, the flexible portion 42A or 42B (i.e., the tongue portion) has only one end connected to the film body 41, and the other end of the flexible portion 42A or 42B opposite to the connected end is the free end 421 or 422. The free end 421 or 422 is adjacent to and below the tail end 303 (i.e., the extension portion 32). The flexible portion 42C (i.e., the bridge structure) has two opposite ends connected to the film body, and the middle of the bridge structure is a suspension section 423. The suspension section 423 is adjacent to and below the tail end 303 (i.e., the extension portion 32). As such, the free end 421 or 422 or the suspension section 423 has a relatively greater amount of elastic deformation with respect to the film body 41. As shown in FIG. 3A, the flexible portion 42A is a tongue portion extending from the film body 41 along the X-axis direction toward the extension portion 32. As shown in FIG. 3B, the flexible portion 42B is a tongue portion extending from the film body 41 along the Y-axis direction toward the extension portion 32. As shown in FIG. 3C, the flexible portion 42C is a bridge structure having an opening 424 to increase the elasticity.

Figure 3D:
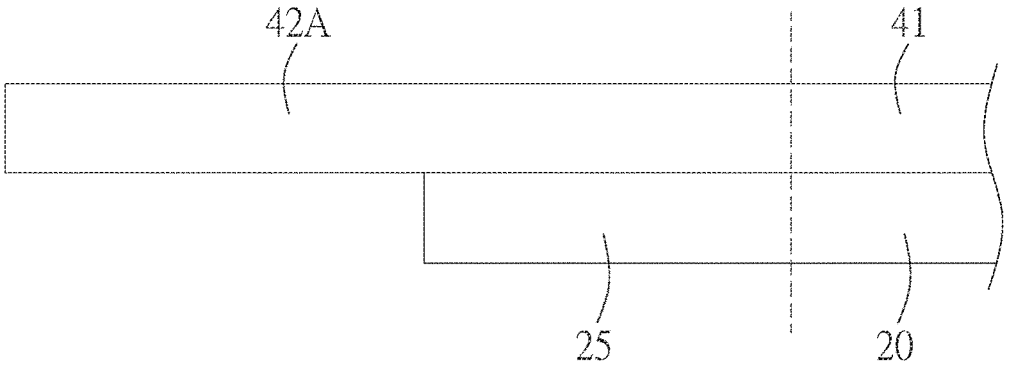
FIG. 3D is a cross-sectional view of the support portion and the flexible portion in an embodiment of the invention.

Moreover, as shown in FIGS. 3A to 3C, the baseplate 20 may have different forms of support portion 25, and the support portion 25 correspondingly partially supports the flexible portion 42A, 42B, or 42C, so as to modify the deformation amount of the flexible portion. For example, as shown in FIG. 3A to 3C, the support portion 25 is embodied as a support bar, which avoids overlapping the extension portion 32 in the Z-axis direction, but maintains at least partially overlapping the flexible portion 42A, 42B, or 42C in the Z-axis direction, but not limited thereto. In another embodiment (not shown), the support portion can be a support structure extending across the flexible portion to partially support the flexible portion, so as to modify the deformation amount of the flexible portion. Furthermore, as shown in FIG. 3D, the support portion 25 of the embodiments of FIGS. 3A to 3C extends horizontally from the baseplate 20, so that the flexible portion 42A, 42B, or 42C is substantially coplanar with the film body 41, but not limited thereto.

Figure 4A:
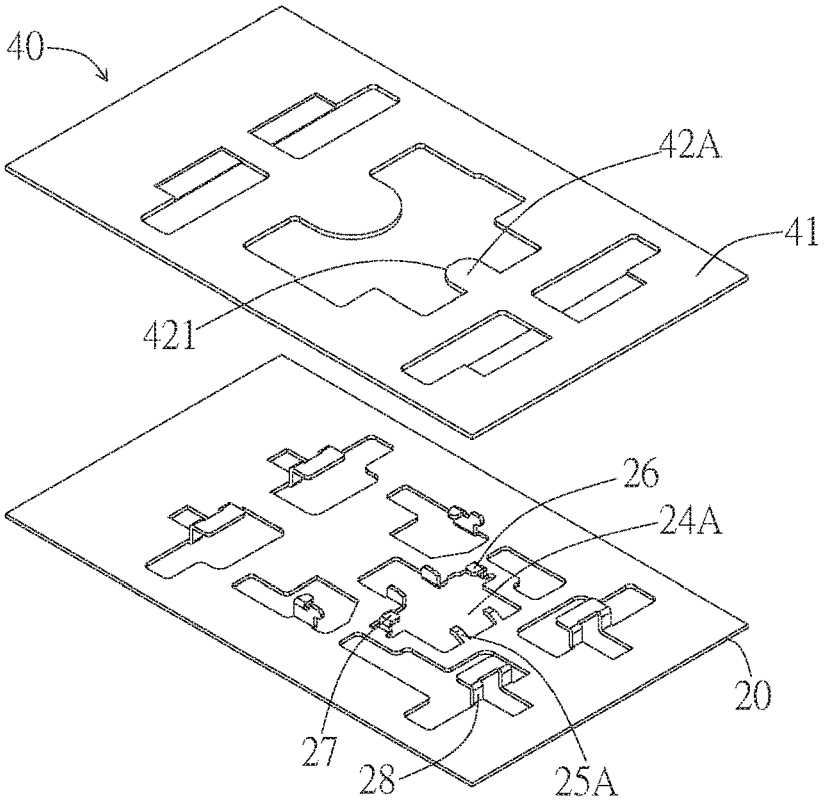
FIG. 4A is a schematic view of the switch film and the baseplate in another variant embodiment of the invention.
Figure 4B:
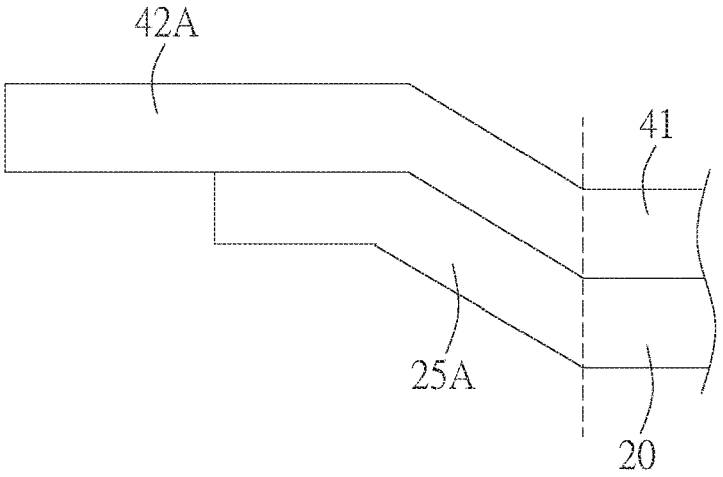
FIG. 4B is a cross-sectional view of the support portion and the flexible portion of FIG. 4A.

In another embodiment, as shown in FIGS. 4A and 4B, the support portion 25A protrudes toward the keycap 10, so that the flexible portion 42A is closer to the keycap 10 than the film body 41 of the switch film 40. Specifically, the support portion 25A is inclined upward from the baseplate 20, so that the flexible portion 42A supported by the support portion 25A is also inclined upward. As such, the free end 421 of the flexible portion 421 is raised toward the keycap 10 and protrudes upward from the film body 41. In such a configuration, the interference amount in the Z-axis direction between the tail end 303 (e.g., the extension portion 32) and the flexible portion 42A can be modified. It is noted the flexible portion 42C can be inclined upward when supported by the support portion 25A (not shown), so that the suspension section 423 is raised toward the keycap 10 and protrudes upward from the film body 41.

Figure 5A:
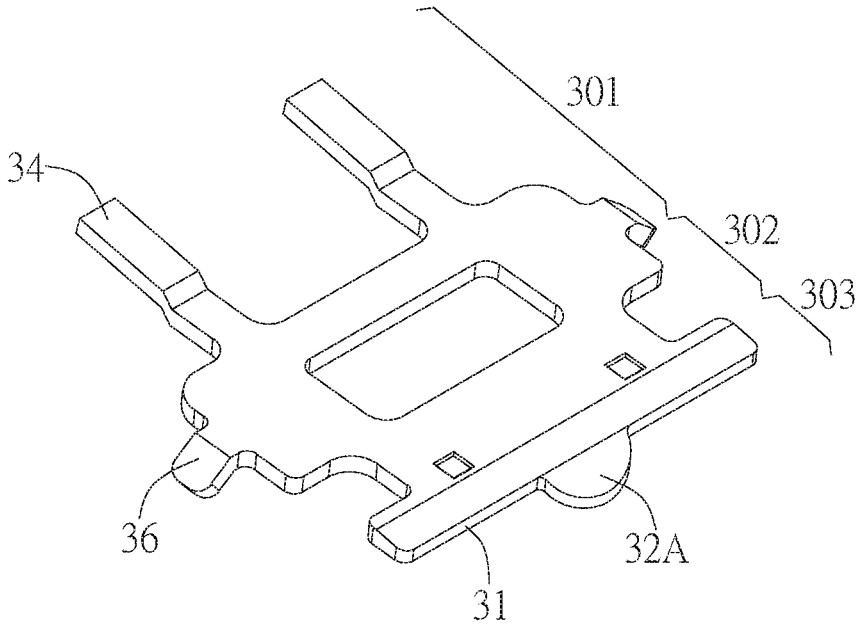
FIGS. 5A and 5B are a schematic view and a side view of the magnetic member in another embodiment of the invention.
Figure 5B:
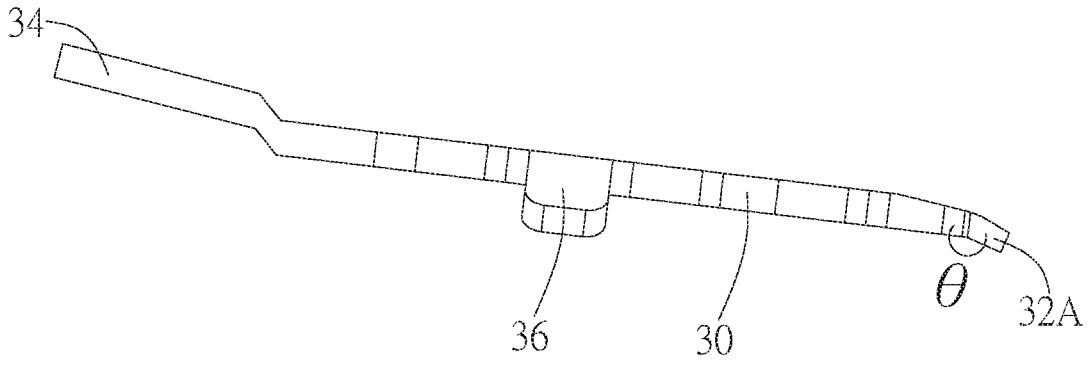
Figure 6A:
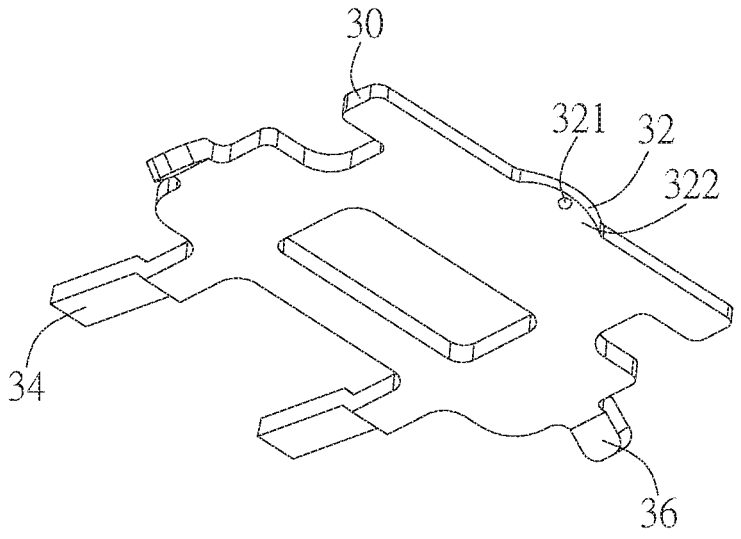
FIGS. 6A and 6B are a schematic view and a side view of the magnetic member in another embodiment of the invention.
Figure 6B:
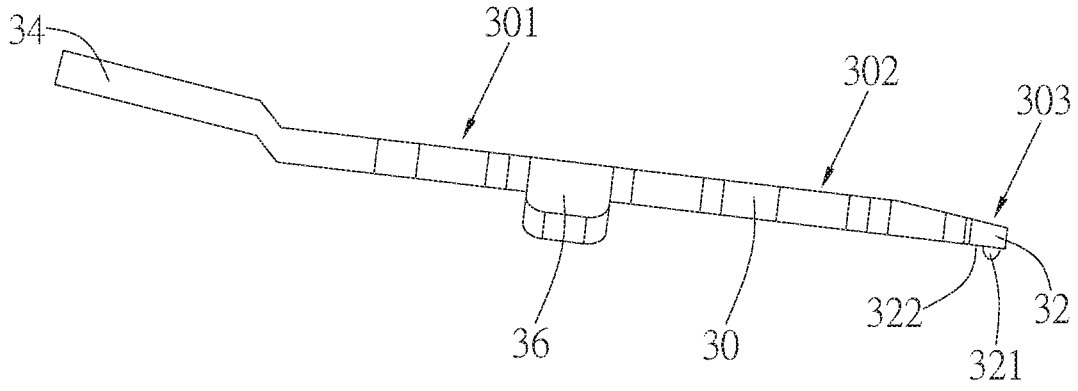

In other embodiments, the keyswitch structure can modify the predetermined interference amount by modifying the tail end or the extension portion. As shown in FIGS. 5A and 5B, in another embodiment, the extension portion 32A is bent toward the flexible portion 42 with respect to the edge 31. Specifically, the extension portion 32A protrudes from the edge 31 and then is bent downward to the direction of the edge 31, so that an angle θ between the extension portion 32A and the magnetic member 30 is smaller than 180 degrees. In other words, the extension portion 32A is inclined downward with respect to where the flexible portion 42 is located, e.g. the X-axis direction, so that the predetermined interference amount between the flexible portion 42 and the extension portion 32A in the Z-axis direction is changed (e.g. reduced). As shown in FIGS. 6A and 6B, in another embodiment, a bump 321 can be disposed at the tail end 303 and the bump 321 protrudes from the bottom surface of the tail end 303 toward the flexible portion 42. Specifically, the bump 321 can be disposed on the extension portion 32 and protrudes from the bottom surface 322 of the extension portion 32 along the Z-axis direction, so that the interference amount between the extension portion 32 and the flexible portion 42 in the Z-axis direction can be reduced. For example, the extension portion 32 can be processed to have the bump 321, which is recessed from the upper surface and protrudes from the bottom surface, but not limited thereto. The bump 321 can be attached to the bottom surface 322 of the extension portion 32 by engaging, adhering, or any suitable attaching methods, and the material of the bump 321 can be an elastic material, such as rubber, polymers, or other materials as appropriate. It is noted that in the embodiment, the bump 321 is disposed on the bottom surface 322 of the extension portion 32 outside the edge 31, but not limited thereto. In another embodiment (not shown), the extension portion can be modified, so that the edge of the tail end and the edge of the extension portion can be substantially the same edge, and the bump 321 can be disposed on the bottom surface of the tail end and at the inner side of the edge.

Figure 7A:
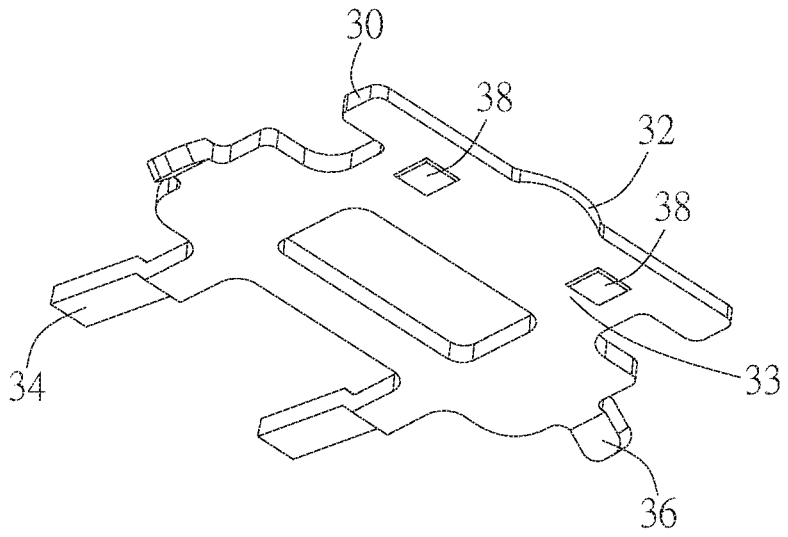
FIGS. 7A and 7B are a schematic view and a side view of the magnetic member in yet another embodiment of the invention.
Figure 7B:
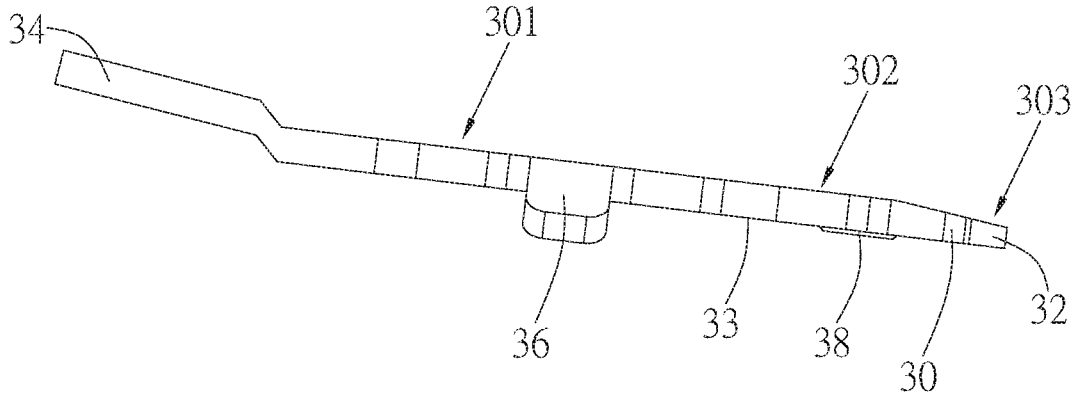

As shown in FIGS. 7A and 7B, in another embodiment, the magnetic member 30 further has a bump 38 extending from a bottom surface 33 of the magnetic member 30 toward the magnetic unit 22. When the keycap 10 is released, the magnetic member 30 contacts the magnetic unit 22 by the bump 38 to drive the support 50 to support the keycap 10 upward at a non-pressed position. Specifically, one or more bumps 38 are preferably partially disposed along the Y-axis direction on the bottom surface 33 of the middle section 302, so that the middle section 302 and the magnetic unit 22 are in point contact with each other by the bump 38. As such the contact area between the magnetic member 30 and the magnetic unit 22 is reduced, and the noise produced when the magnetic member 30 contacts the magnetic unit 22 can be reduced. For example, the magnetic member 30 can be processed to form the bump 38 at the middle section, wherein the bump 38 is recessed from the upper surface and protrudes from the bottom surface, but not limited thereto. In another embodiment, the bump 38 can be attached to the bottom surface 33 of the middle section 302 by engaging, adhering, or any suitable attaching methods, and the material of the bump 38 can be an elastic material, such as rubber, polymers, or other materials as appropriate.

Figure 8A:
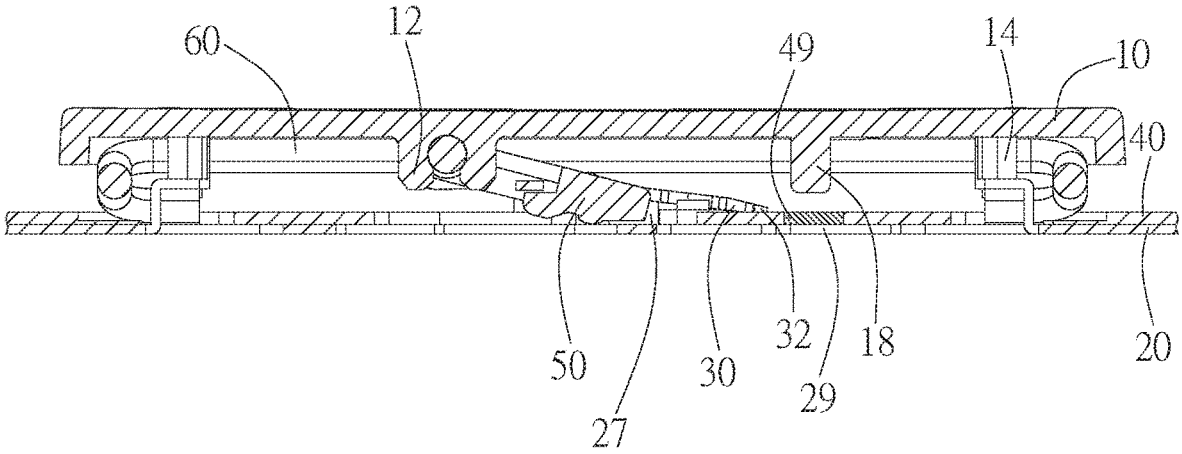
FIGS. 8A and 8B are cross-sectional views of the keyswitch structure in an embodiment of the invention at the non-pressed position and the pressed position, respectively.
Figure 8B:
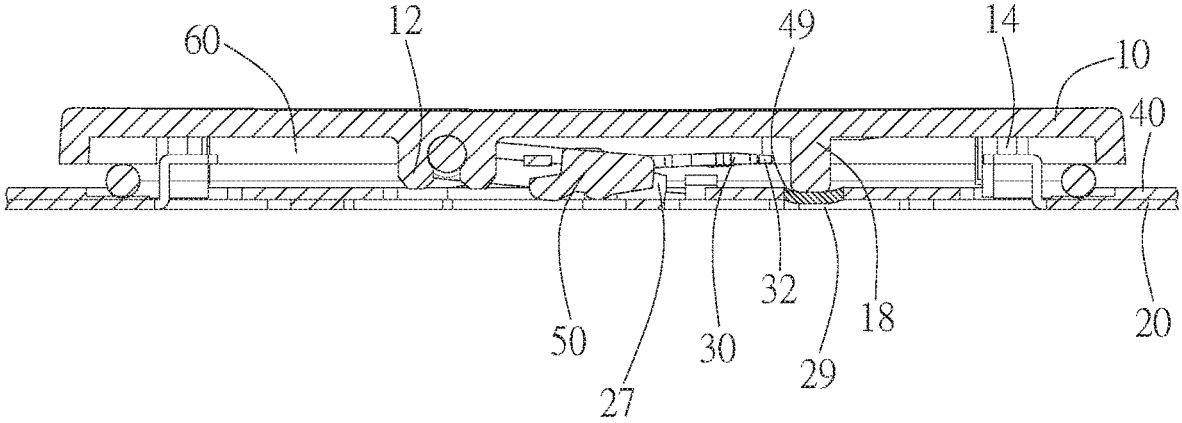

In an embodiment, as shown in FIGS. 8A and 8B, the keycap 10 further has a protrusion 18. The protrusion 18 extends from the bottom surface of the keycap 10 toward the baseplate 20. The baseplate 20 has an accommodation space 29 corresponding to the protrusion 18, and the switch film 40 covers the accommodation space 29. When the keycap 10 is pressed, the protrusion 18 presses the switch film 40 into the accommodation space 29. Specifically, the portion of the switch film 40 that covers the accommodation space 29 is preferably a deformable portion 49. For example, the deformable portion 49 can be a portion of the switch film 40 that is a relatively thinner in thickness or is partially connected to film body of the switch film 40, so that the deformable portion 49 can have a larger amount of deformation than other portions of the switch film 40 around the deformable portion 49. With the design of the deformable portion 49, the switch film 40 can have a suitable bulk thickness to increase the manufacturability and reduce the possibility of damaging the switch film 40. The portion of the switch film 40 connected to the deformable portion 49 is covered on the baseplate surface around the accommodating space 29, so that the deformable portion 49 can provide a cushion mechanism for the downward movement of the protrusion 18 of the keycap 10 by elastic deformation to reduce noise.

Specifically, when the keycap 10 is pressed, the keycap 10 moves downward to a lower position, and the lower end of the protrusion 18 presses the deformable portion 49 toward the accommodation space 29, so that the deformable portion 49 is deformed and extends to the accommodation space 29. With such a configuration, without increasing the height of the keyswitch structure, the protrusion 18 of the keycap 10 will have a larger downward moving space, and the deformable portion 49 abutting the protrusion 18 serves as a cushion elastic member to effectively reduce the noise.

It is noted that in the above embodiments, the switch film 40 has a structure of multiple layers, and the flexible portion 42 (or the deformable portion 49) is preferably formed by at least one of the multiple layers of the switch film 40. For example, as shown in FIG. 1C1, the switch film 40 can be a structure of three layers, wherein the upper layer 40*a* and the lower layer 40*b* can be circuit layers, and the middle layer 40*c* is an interposed layer disposed between the upper layer 40*a* and the lower layer 40*b* to separate the circuits in the upper layer 40*a* and the lower layer 40*b*. When the keycap 10 moves toward the baseplate 20 to trigger the switch film 40, the circuits in the upper layer 40*a* and the lower layer 40*b* are conducted to generate the triggering signal. The flexible portion 42 (or the deformable portion 49) can be independently formed by any one or two of the upper layer 40*a*, the middle layer 40*c*, and the lower layer 40*b*, so that the flexible portion 42 (or the deformable portion 49) may have suitable amount of deformation according to practical applications.

Figure 9A:
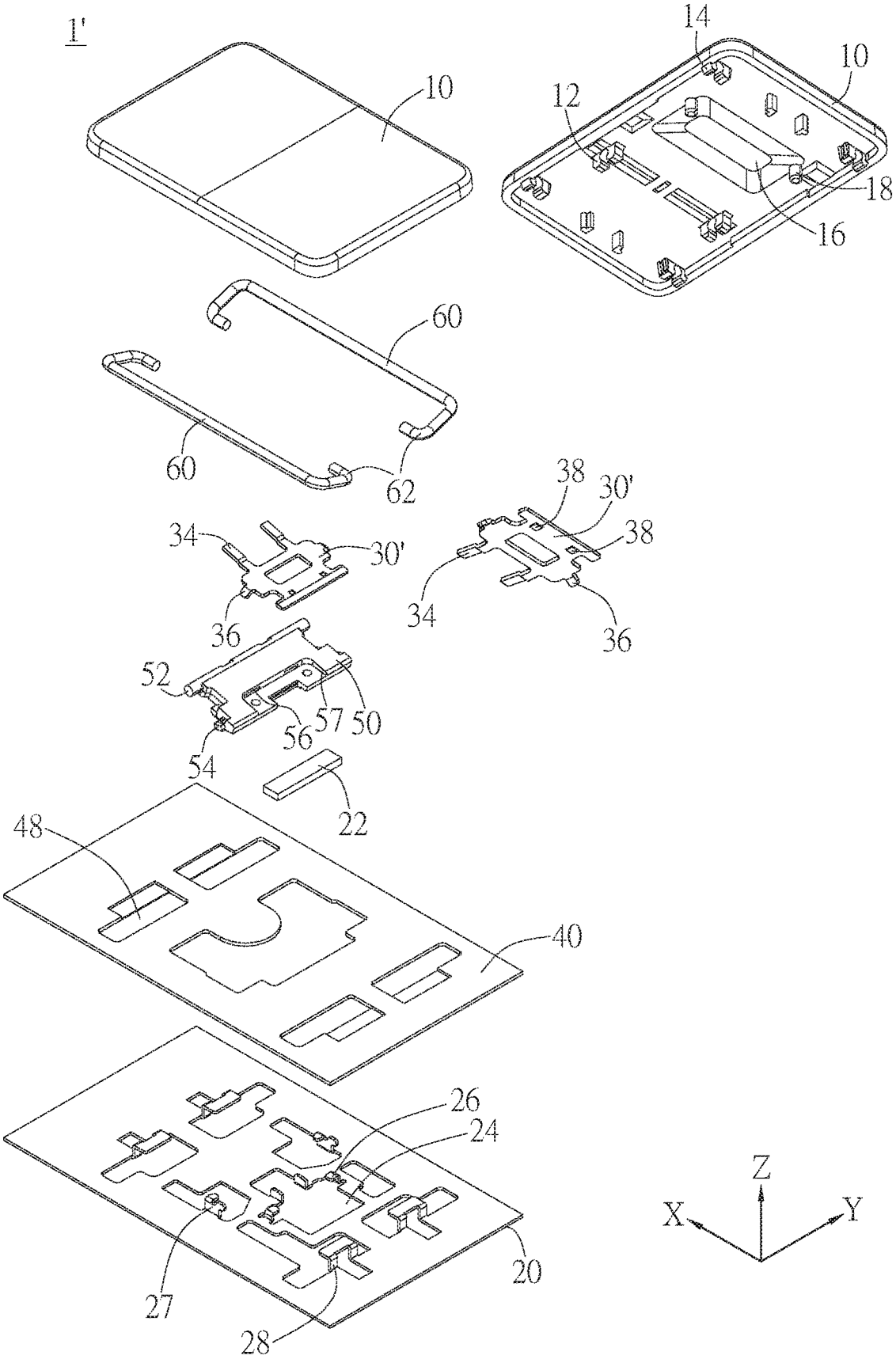
FIG. 9A is an exploded view of the keyswitch structure in another embodiment of the invention.
Figure 9B:
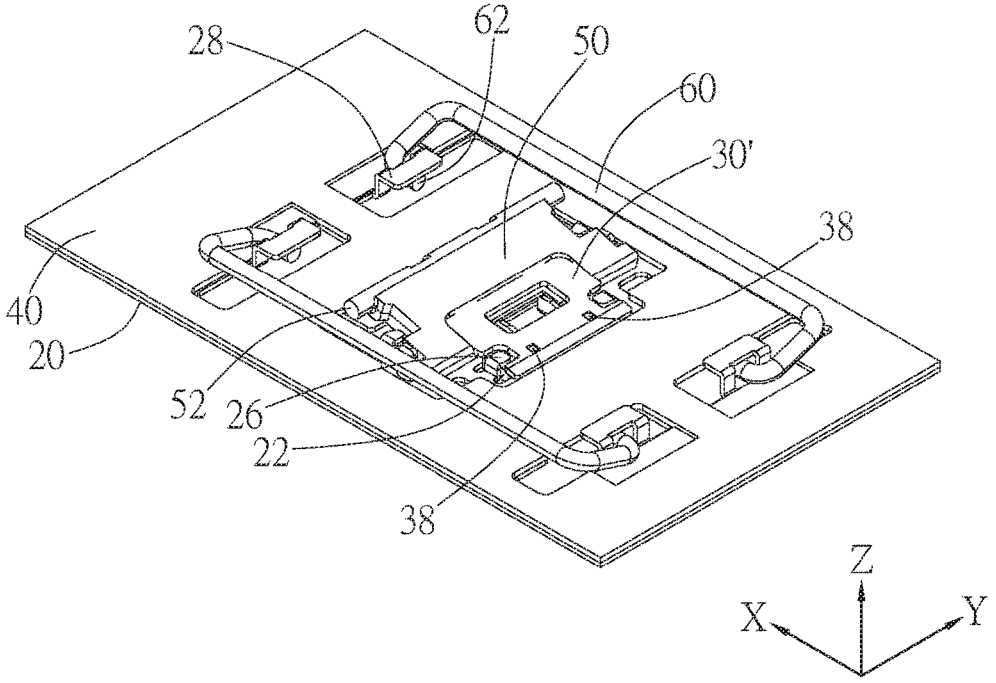
FIG. 9B is a schematic view of the keyswitch structure of FIG. 9A without the keycap.
Figure 9C:
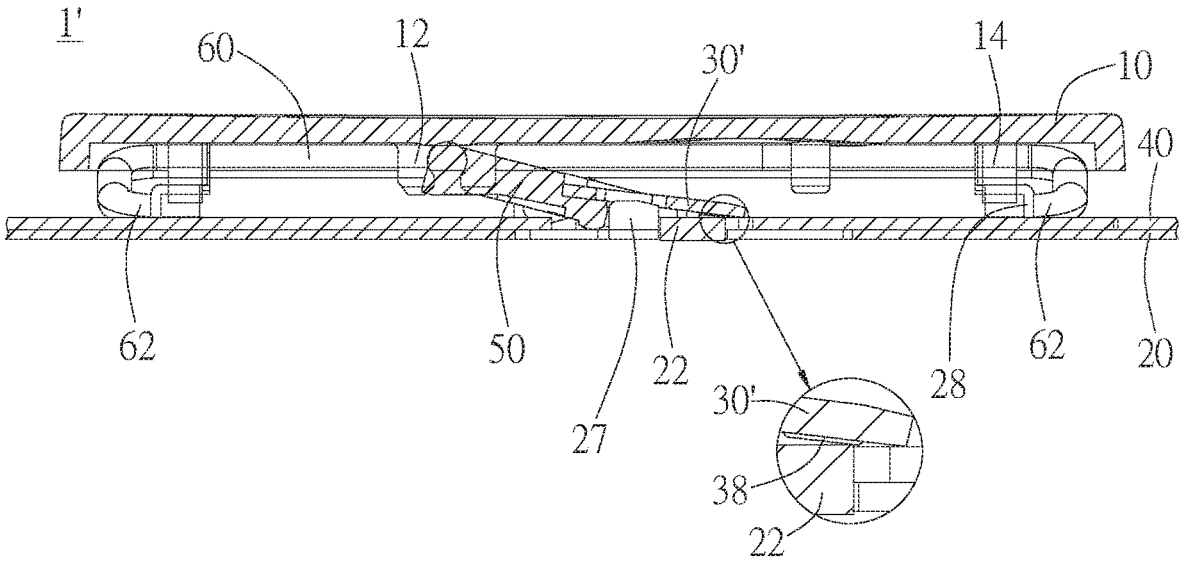
FIG. 9C is a cross-sectional view of the keyswitch structure of FIG. 9A.

FIGS. 9A to 9C are schematic views of another embodiment of the invention, wherein FIG. 9A is an exploded view of the keyswitch structure; FIG. 9B is a schematic view of the keyswitch structure of FIG. 9A without the keycap; FIG. 9C is a cross-sectional view of the keyswitch structure of FIG. 9A. As shown in FIGS. 9A to 9C, the keyswitch structure 1' includes a keycap 10, a baseplate 20, a support 50, a magnetic member 30', and a magnetic unit 22. The baseplate 20 is disposed below the keycap 10. The support 50 is movably disposed between the baseplate 20 and the keycap 10. The magnetic member 30' couples with the support 50, and the magnetic member 30' has a bump 38 extends from the bottom surface of the magnetic member 30' toward the baseplate 20. The magnetic unit 22 is correspondingly disposed below the magnetic member 30', and a magnetic attraction force exists between the magnetic member 30' and the magnetic unit 22. When the keycap 10 is pressed, the support 50 enables the magnetic member 30' to move away from the magnetic unit 22. When the keycap 10 is released, the magnetic attraction force between the magnetic unit 22 and the magnetic member 30' enables the magnetic member 30' to move toward the magnetic unit 22, so the bump 38 contacts the magnetic unit 22 to drive the support 50 to support the keycap 10 upward.

For example, the magnetic member 30' can be processed to form the bump 38, which is recessed from the upper surface and protrudes from the bottom surface, but not limited thereto. In another embodiment, the bump 38 can be attached to the bottom surface 33 of the magnetic member 30' by engaging, adhering, or any suitable attaching methods, and the material of the bump 38 can be an elastic material, such as rubber, polymers, or other materials as appropriate. The keyswitch structure 1' utilizes the bump 38 of the magnetic member 30' to achieve point contact with the magnetic unit 22, so as to reduce the contact area between the magnetic member 30' and the magnetic unit 22 and further to reduce the noise generated when the magnetic member 30' contacts the magnetic unit 22. It is noted that according to practical applications, the keyswitch structure 1' may include other components, such as switch layer 40, linking bar 60, and the structure and connection of components of the keyswitch structure 1' can be referred to the related descriptions of the above embodiments, and will not elaborate again.

Although the preferred embodiments of the present invention have been described herein, the above description is merely illustrative. The preferred embodiments disclosed will not limit the scope of the present invention. Further modification of the invention herein disclosed will occur to those skilled in the respective arts and all such modifications are deemed to be within the scope of the invention as defined by the appended claims.

What is claimed is:

1. A keyswitch structure, comprising:

a keycap;

a baseplate disposed below the keycap, the baseplate having a buffer space;

a support movably disposed between the baseplate and the keycap;

a magnetic member having a front section, a middle section, and a tail end, the front section coupling with the support;

a magnetic unit disposed below the magnetic member; and a switch film disposed on the baseplate, the switch film having a flexible portion extending over the buffer space, wherein when the keycap is pressed, the support enables the magnetic member to move away from the magnetic unit, so the tail end is away from the flexible portion; and wherein when the keycap is released, a magnetic attraction force between the magnetic unit and the magnetic member enables the magnetic member to move toward the magnetic unit, so the tail end firstly contacts the flexible portion and pushes the flexible portion to deform toward the buffer space, and then the middle section contacts the magnetic unit to drive the support to support the keycap upward.

2. The keyswitch structure of claim 1, wherein the tail end has an edge and an extension portion protruding from the edge; when the keycap is released, the magnetic attraction force enables the magnetic member to move toward the magnetic unit, so only the extension portion firstly contacts the flexible portion to push the flexible portion to deform toward the buffer space, and the edge remains separated from the flexible portion.

3. The keyswitch structure of claim 2, wherein when the keycap is released and the extension portion contacts the flexible portion, a vertical projection of the edge of the tail end on the baseplate and a vertical projection of the flexible portion on the baseplate do not overlap with each other.

4. The keyswitch structure of claim 2, wherein the extension portion is bent toward the flexible portion with respect to the edge.

5. The keyswitch structure of claim 1, wherein the tail end has a bump; the bump protrudes from a bottom surface of the tail end toward the flexible portion.

6. The keyswitch structure of claim 1, wherein the baseplate further has a receiving space and positioning portions; the receiving space communicates with the buffer space, and the positioning portions are disposed at two opposite sides neighboring the receiving space.

7. The keyswitch structure of claim 1, wherein the switch film has a structure of multiple layers, and the flexible portion is formed by at least one of the multiple layers of the switch film.

8. The keyswitch structure of claim 1, wherein the switch film has a film body, and the flexible portion is a bridging portion with two ends connected to the film body to define two openings with the film body at two sides of the flexible portion.

9. The keyswitch structure of claim 1, wherein the switch film has a film body, and the flexible portion is a tongue portion extending from the film body to have a free end corresponding to the tail end; the free end is adjacent to and below the tail end.

10. The keyswitch structure of claim 1, wherein the switch film has a film body, and the flexible portion is a bridge structure extending from the film body and having a suspension section adjacent to and below the tail end.

11. The keyswitch structure of claim 1, wherein the baseplate has a support portion, and the support portion partially supports the flexible portion.

12. The keyswitch structure of claim 11, wherein the support portion protrudes toward the keycap, so that the flexible portion is closer to the keycap than a film body of the switch film.

13. The keyswitch structure of claim 1, wherein the keycap has a protrusion; the protrusion extends from a bottom surface of the keycap toward the baseplate; the baseplate has an accommodation space corresponding to the protrusion; the switch film covers the accommodation space; when the keycap is pressed, the protrusion presses the switch film into the accommodation space.

14. The keyswitch structure of claim 1, wherein the magnetic member further has a bump extending from a bottom surface of the magnetic member; when the keycap is released, the magnetic member contacts the magnetic unit by the bump to support the keycap at a non-pressed position.

15. A keyswitch structure, comprising:

a keycap;

a baseplate disposed below the keycap;

a support movably disposed between the baseplate and the keycap;

a magnetic member coupling with the support, the magnetic member having a bump extending from a bottom surface of the magnetic member toward the baseplate; and a magnetic unit disposed below the magnetic member, wherein when the keycap is pressed, the support drives the magnetic member to move away from the magnetic unit; and wherein when the keycap is released, a magnetic attraction force between the magnetic unit and the magnetic member enables the magnetic member to move toward the magnetic unit, so the bump contacts the magnetic unit to drive the support to support the keycap upward.

* * * * *